US011498201B2

(12) United States Patent
Li

(10) Patent No.: US 11,498,201 B2
(45) Date of Patent: Nov. 15, 2022

(54) JOINT FOR A SWING WRENCH

(71) Applicant: Yi-Min Li, Taichung (TW)

(72) Inventor: Yi-Min Li, Taichung (TW)

( * ) Notice: Subject to any disclaimer, the term of this patent is extended or adjusted under 35 U.S.C. 154(b) by 1067 days.

(21) Appl. No.: 16/160,690

(22) Filed: Oct. 15, 2018

(65) Prior Publication Data

US 2020/0114503 A1 Apr. 16, 2020

(51) Int. Cl.

| | |
|---|---|
| ***B25H 3/02*** | (2006.01) |
| ***B65D 45/06*** | (2006.01) |
| ***B65D 45/16*** | (2006.01) |
| *B65D 45/18* | (2006.01) |
| *B65D 45/24* | (2006.01) |

(52) U.S. Cl.

CPC ..... *B25H 3/02* (2013.01); *B65D 45/06* (2013.01); *B65D 45/16* (2013.01); *B65D 45/18* (2013.01); *B65D 45/24* (2013.01)

(58) Field of Classification Search

CPC . A44B 11/2588; A44B 11/2553; A44B 11/22; A44B 11/2576; B25H 3/02; B65D 45/06; B65D 45/16; B65D 45/18; B65D 45/24

See application file for complete search history.

(56) References Cited

U.S. PATENT DOCUMENTS

| | | | | |
|---|---|---|---|---|
| 48,503 | A * | 7/1865 | Bailey | A44B 11/22 24/174 |
| 3,749,366 | A * | 7/1973 | Brucker | B60P 7/083 24/68 CD |
| 4,951,365 | A * | 8/1990 | Loyd | A44B 11/125 24/68 CD |
| 5,933,923 | A * | 8/1999 | Catlos | A44B 11/02 24/265 AL |
| 8,316,511 | B2 * | 11/2012 | Huang | B60P 7/083 24/68 CD |
| 9,623,788 | B2 * | 4/2017 | Eenigenburg | B60P 7/0838 |
| 2003/0000047 | A1 * | 1/2003 | Mamie | B60P 7/0823 24/68 CD |
| 2005/0278902 | A1 * | 12/2005 | Wilcox | B60P 7/0861 24/68 CD |
| 2007/0024805 | A1 * | 2/2007 | Sasaki | G02C 9/02 351/47 |
| 2007/0283540 | A1 * | 12/2007 | Chang | B60P 7/0838 24/68 CD |
| 2009/0133234 | A1 * | 5/2009 | Chang | B60P 7/0838 24/68 CD |

* cited by examiner

*Primary Examiner* — Kareen K Thomas

(57) ABSTRACT

A tool box-used buckling apparatus includes a buckle, a sleeve, a shaft and two limiting elements. The buckle includes two substantially parallel lateral strips. The lower shaft includes a middle section inserted in the sleeve and two terminal sections inserted in the lateral strips. The limiting elements extend toward each other from the lateral strips. The limiting elements are in contact with two ends of the sleeve, thereby keeping the sleeve on the middle section of the lower shaft.

8 Claims, 6 Drawing Sheets

JOINT FOR A SWING WRENCH

BACKGROUND OF INVENTION

1. Field of Invention

The present invention relates to a tool box and, more particularly, to a buckling apparatus for a tool box.

2. Related Prior Art

A conventional tool box includes a case, a cover pivotally connected to the case, and a buckling apparatus for locking the cover to the case. The buckling apparatus inevitably gets worn away and becomes slack after some time of use.

As disclosed in Taiwanese Patent No. 496543 for example, a conventional buckling apparatus includes a buckle 10, a biasing element 11 and a sleeve 1000. A pin 12 is used to connect two lateral strips of the buckle 10 to a cover 2 for a box 3. Another pin is used to connect the sleeve 1000 to a pivotal portion 100 of the buckle 10. The pivotal portion 100 of the buckle 10 includes a limiting strip 103 that are formed with two bosses for contact with two ends of the sleeve 1000, thereby keeping the sleeve 1000 on a middle section of the shaft 12. However, it involves a complicated and hence expensive process to produce the limiting strip 103. Moreover, the lateral strips of the buckle 10 will eventually cut the pin 12 after some time of use.

The present invention is therefore intended to obviate or at least alleviate the problems encountered in prior art.

SUMMARY OF INVENTION

It is the primary objective of the present invention to provide a tool box with a durable buckling apparatus.

To achieve the foregoing objective, the buckling apparatus includes a buckle, a sleeve, a shaft and two limiting elements. The buckle includes two substantially parallel lateral strips. The lower shaft includes a middle section inserted in the sleeve and two terminal sections inserted in the lateral strips. The limiting elements extend toward each other from the lateral strips. The limiting elements are in contact with two ends of the sleeve, thereby keeping the sleeve on the middle section of the lower shaft.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
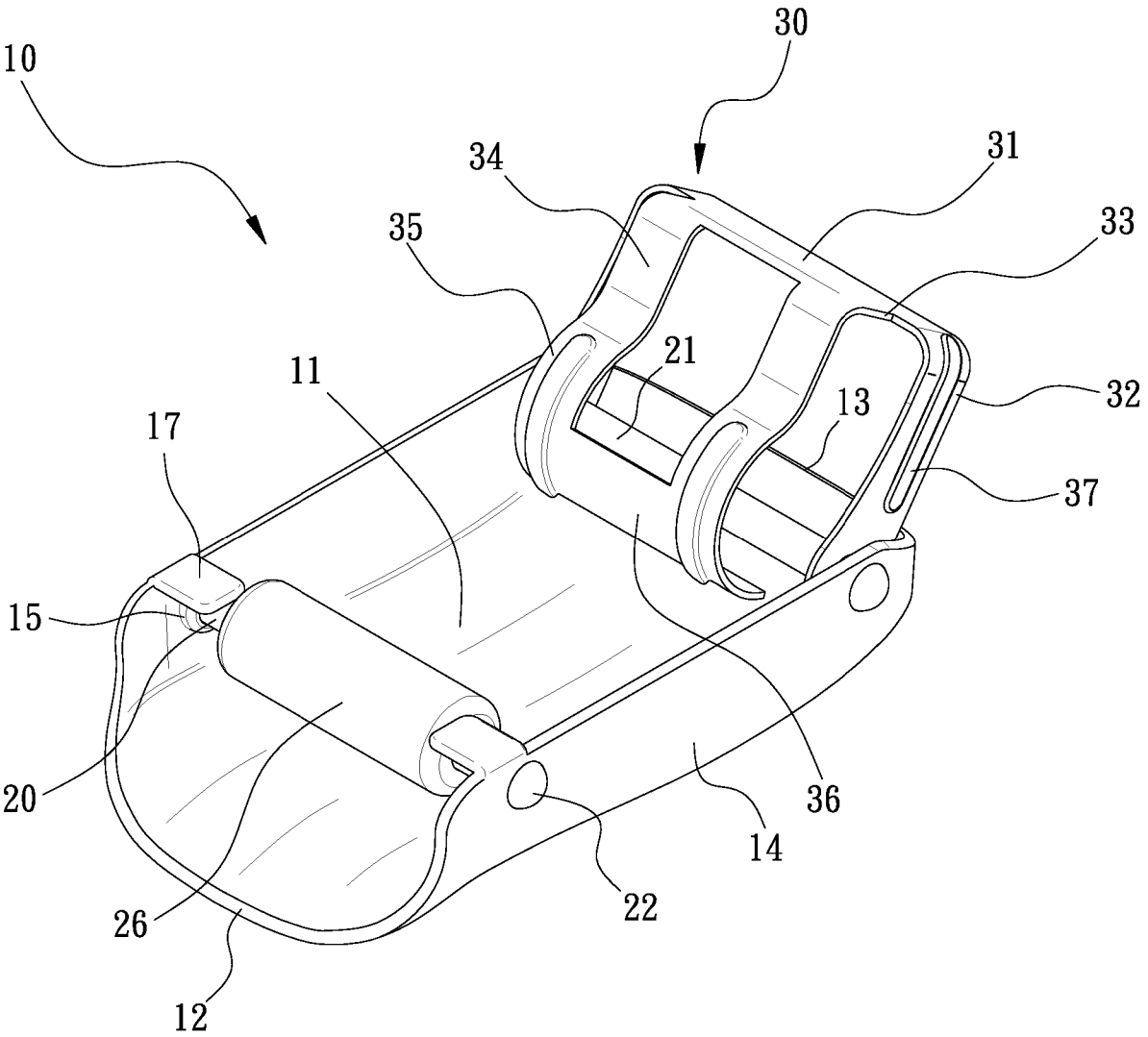
FIG. 1 is a perspective view of a buckling apparatus according to the preferred embodiment of the present invention.
Figure 2:
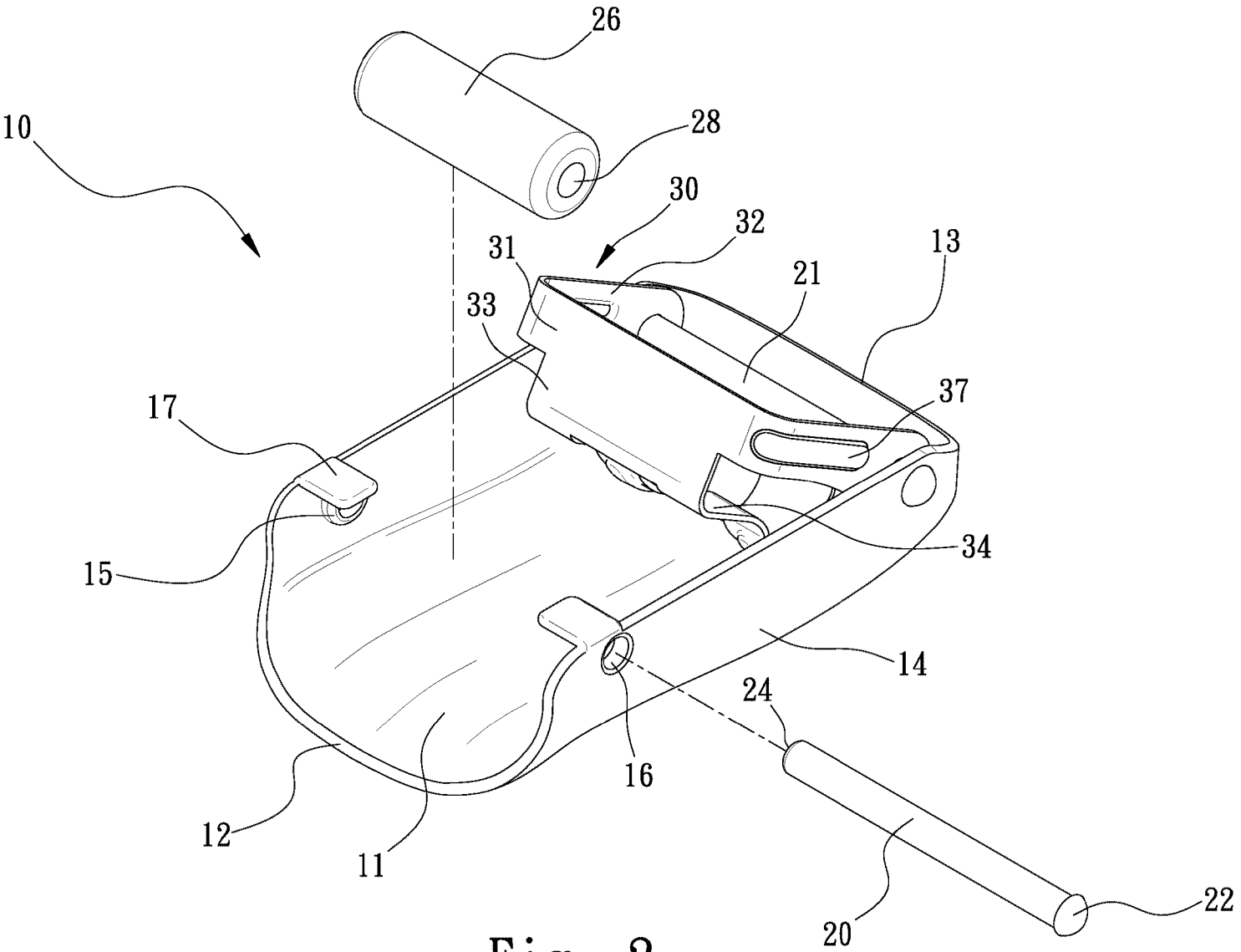
FIG. 2 is an exploded view of the buckling apparatus shown in FIG. 1.
Figure 3:
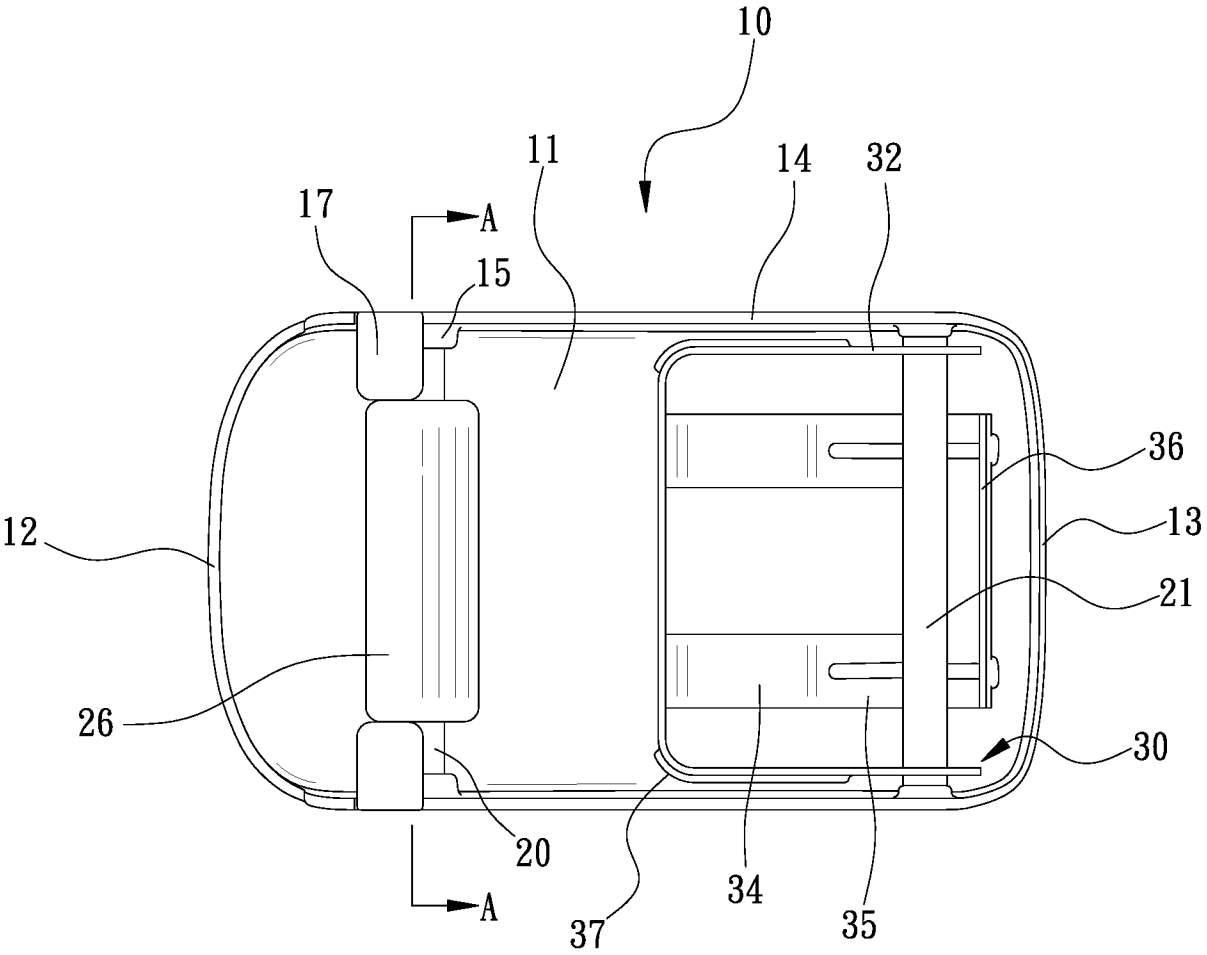
FIG. 3 is a rear view of the buckling apparatus shown in FIG. 1.
Figure 4:
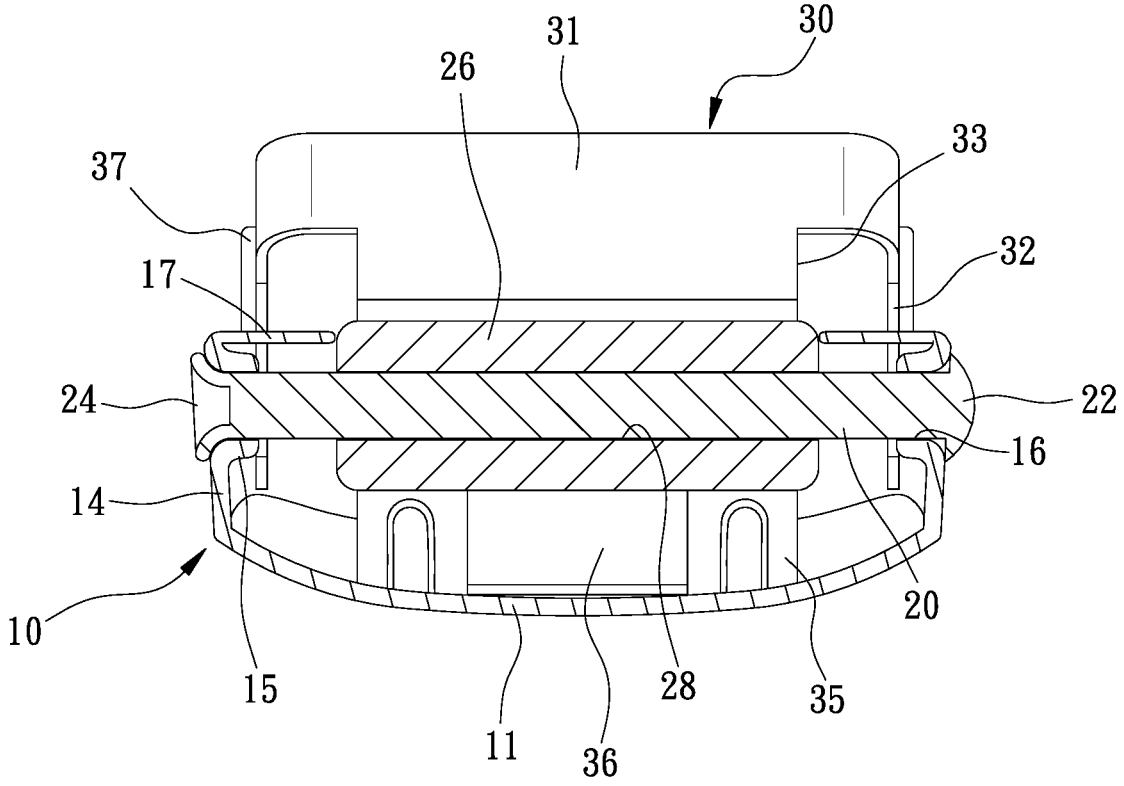
FIG. 4 is a cross-sectional view of the buckling apparatus taken along a line A-A shown in FIG. 3.
Figure 5:
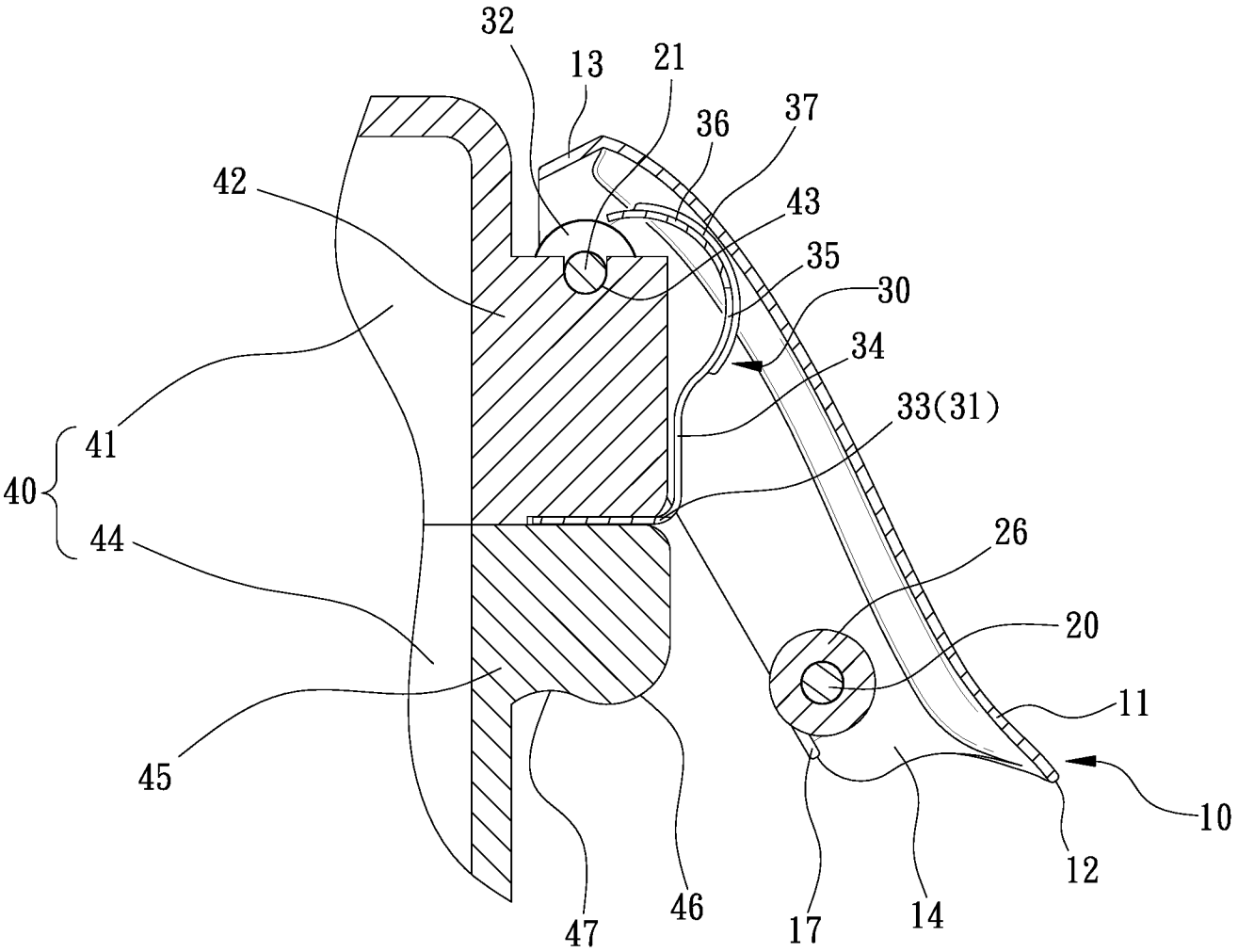
FIG. 5 is a cross-sectional view of a tool box and the buckling apparatus shown in FIG. 4.
Figure 6:
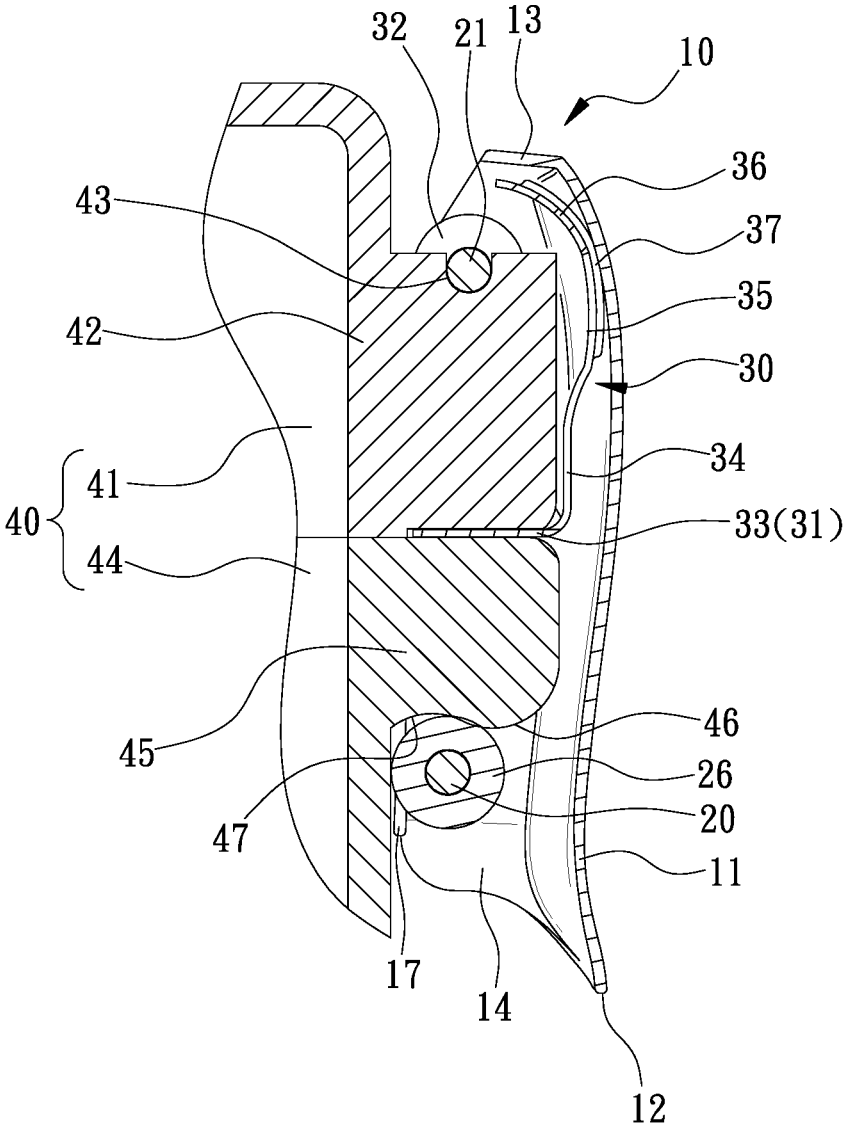
FIG. 6 is a cross-sectional view of the tool box and the buckling apparatus in another position than shown in FIG. 5.

Referring to FIGS. 1 through 4, a buckling apparatus 10 includes a buckle 11, a sleeve 26 and a biasing element 30 according to the preferred embodiment of the present invention. The buckling apparatus 10 is used on a tool box 40 (FIGS. 5 and 6).

The biasing element 30 is preferably made of a metal plate and includes a U-shaped unit and an elastic unit. The U-shaped unit and the elastic strips are made in one piece. The U-shaped unit includes a transverse strip 31, two cranks 32 and an extensive portion 33. The transverse strip 31 is a flat portion formed between the cranks 32, which extend parallel to each other. Each of the cranks 32 is formed with a reinforcing rib 37. The extensive portion 33 extends in a same plane with the transverse strip 31.

The elastic unit preferably includes two elastic strips. Each of the elastic strips includes a rectilinear portion 34 and an arched portion 35. The rectilinear portion 34 extends from the extensive portion 33, with an angle of about 90 degrees between them. The arched portion 35 extends from the rectilinear portion 34. The biasing element 30 further includes a transverse portion 36 formed between the arched portions 35 of the elastic strips. The transverse portion 36 is intended to reinforce the elastic unit of the biasing element 30.

In another embodiment, the elastic unit of the biasing element 30 can include only one elastic strip. In such case, the transverse portion 36 is omitted.

The buckle 11 includes a panel, an upper strip 13 and two lateral strips 14. The panel, the upper strip 13 and the lateral strips 14 are made in one piece. The panel extends perpendicular to the upper strip 13 and the lateral strips 14. The upper strip 13 extends between and perpendicular to the lateral strips 14. Thus, a space is provided in the buckle 11. The space of the buckle 11 includes an open end 12 opposite to the upper strip 13.

Each of the lateral strips 14 includes two annular portions 15 (the "upper" and "lower" annular portions), two apertures 16 (the "upper" and "lower" apertures) and a limiting element 17. The upper and lower annular portions 15 are formed on an internal side of the corresponding lateral strip 14 so that the upper and lower annular portions 15 are located in the space of the buckle 11. The upper aperture 16 is located in the upper annular portion 15. The lower aperture 16 is located in the lower annular portion 15. The upper and lower apertures 16 are in communication with the space of the buckle 11. Each of the limiting elements 17 extends from an edge of the corresponding lateral strip 14 at an angle of about 90 degrees. Each of the limiting elements 17 is located near a corresponding one of the lower annular portions 15.

The sleeve 26 is made of an elastic material so that it can be compressed when a force is exerted on it and recover when the force is removed from it. A lower shaft 20 includes a middle section inserted in an axial channel 28 of the sleeve 26 and two terminal sections inserted in the lower apertures 16, which are located in the lower annular portions 15. Each of the limiting elements 17 is in contact with two ends of the sleeve 26, thereby keeping the sleeve 26 on and around the middle section of the lower shaft 20, near the open end 12 of the buckle 11.

Preferably, the lower shaft 20 is a rivet that includes a head 22 and an end 24 that is enlarged after it is extended through one of the lower apertures 16. Now, the head 22 and the end 24 are given a diameter greater than that of the lower apertures 16, thereby keeping the lower shaft 20 and the sleeve 26 on the buckle 11.

In another embodiment, the lower annular portions 15 can be omitted without affecting the connection of the lower shaft 20 to the lateral strips 14 or the support of the sleeve 26 on the buckle 11.

An upper shaft 21 includes two terminal sections inserted in the upper apertures 16, which are located in the upper annular portions 15. The cranks 32 are connected to the upper shaft 21. Thus, the cranks 32 are pivotally connected to the buckle 11 via the upper shaft 21. That is, the biasing element 30 is rotatable relative to the buckle 11 because of the upper shaft 21. The arched portions 35 and the transverse portion 36 extend around the upper shaft 21.

Preferably, the upper shaft 21 is a rivet. The connection of the upper shaft 21 to the lateral strips 14 is similar to the connection of the lower shaft 20 to the lateral strips 14 and hence will not be described in detail for briefness.

In another embodiment, the upper annular portions 15 can be omitted without affecting the connection of the upper shaft 21 to the lateral strips 14 or the support of the biasing element 30 on the buckle 11.

Referring to FIG. 5, the tool box 40 includes a cover 41 and a case 44. The cover 41 is connected to the case 44 by two hinges (not shown) for example so that cover 41 is rotatable relative to the case 44 between an open position and a closed position.

The cover 41 is formed with an upper engaging portion 42. The upper engaging portion 42 is formed with a recess 43 that receives the upper shaft 21. The upper engaging portion 42 includes a lower face in contact with the transverse strip 31 and the extensive portion 33. For the use of the cranks 32, the biasing element 30 is kept on the cover 41. The rectilinear portions 34 keep the arched portions 35 and the transverse portion 36 in contact with the buckle 11, thereby biasing the buckle 11 from the cover 41. The upper strip 13 can be abutted against the cover 41 to keep the pivoting of the buckle 11 from the cover 41 in a proper range.

The case 44 includes a lower engaging portion 45. The lower engaging portion 45 includes a convex portion 46 and a concave portion 47. The convex portion 46 is located next to the concave portion 47. The upper engaging portion 42 is located on the lower engaging portion 45 when the tool box 40 is in the closed position. There is a gap between the convex portion 46 and the sleeve 26.

Referring to FIG. 6, the buckle 11 is pivoted to the case 44. Thus, the sleeve 26, which is elastic, is forced into the concave portion 47 past the convex portion 46. Now, the arched portions 35 bias an upper portion of the buckle 11 away from the tool box 40, thereby keeping the elastic sleeve 26 in the concave portion 47. Thus, the buckling apparatus 10 keeps the tool box 40 in the closed position.

The buckling apparatus 10 exhibits several advantageous features. Firstly, the volume of each of the limiting elements 17 is small. Thus, the cost in the production of the locking apparatus 10 is low.

Secondly, the annular portions 15 reinforce the lateral strips 14 and prevent the lateral strips 14 from cutting the lower shaft 20 or the upper shaft 21. Thus, the life of service of the buckling apparatus is long.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A box-used buckling apparatus comprising:

a buckle comprising two substantially parallel lateral strips;

a sleeve;

a lower shaft comprising a middle section inserted in the sleeve and two terminal sections inserted in the lateral strips;

two limiting elements extending toward each other from the lateral strips, wherein the limiting elements are in contact with two ends of the sleeve, thereby keeping the sleeve on the middle section of the lower shaft;

an upper shaft comprising two lateral sections inserted in the lateral strips, and a biasing element connected to the upper shaft so that the biasing element is rotatable relative to the buckle via the upper shaft.

2. The box-used buckling apparatus according to claim 1, wherein each of the lateral strips comprises an annular portion on an internal side and an aperture located in the annular portion, wherein the annular portions of the lateral strips support the lower shaft when the terminal sections of the lower shaft are inserted in the apertures of the lateral strips.

3. The box-used buckling apparatus according to claim 1, wherein the lower shaft is a rivet.

4. The box-used buckling apparatus according to claim 1, wherein the biasing element comprises a U-shaped unit connected to the upper shaft.

5. The box-used buckling apparatus according to claim 4, wherein the U-shaped unit of the biasing element comprises two cranks connected to the upper shaft and a transverse strip formed between the cranks.

6. The box-used buckling apparatus according to claim 5, wherein the biasing element comprises at least one elastic strip comprising a rectilinear portion extending from the transverse strip and an arched portion extending from the rectilinear portion, wherein the arched portion extends around the upper shaft.

7. The box-used buckling apparatus according to claim 6, wherein the biasing element comprises two elastic strips and a transverse portion formed between the arched portions of the elastic strips.

8. The box-used buckling apparatus according to claim 1, wherein the upper shaft is a rivet.

* * * * *